US011092922B2

(12) United States Patent
Matsumoto et al.

(10) Patent No.: US 11,092,922 B2
(45) Date of Patent: Aug. 17, 2021

(54) BINDING DEVICE AND IMAGE FORMING SYSTEM

(71) Applicant: FUJIFILM Business Innovation Corp., Tokyo (JP)

(72) Inventors: Masashi Matsumoto, Kanagawa (JP); Yutaka Nobe, Kanagawa (JP); Hideaki Ozawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/848,822

(22) Filed: Apr. 14, 2020

(65) Prior Publication Data

US 2021/0109473 A1 Apr. 15, 2021

(30) Foreign Application Priority Data

Oct. 10, 2019 (JP) ..... JP2019-186735

(51) Int. Cl.
*B65H 37/04* (2006.01)
*G03G 15/00* (2006.01)

(52) U.S. Cl.
CPC ..... *G03G 15/6544* (2013.01); *B65H 37/04* (2013.01); *B65H 2301/5161* (2013.01); *B65H 2801/06* (2013.01); *G03G 2215/00848* (2013.01)

(58) Field of Classification Search
CPC ..... B31F 1/07; B31F 5/02; G03G 15/6544; G03G 2215/00852; B65H 37/04; B65H 2801/06; B65H 2801/27; B65H 2301/51616; B65H 2301/5161
USPC ..... 270/58.07, 58.08
See application file for complete search history.

(56) References Cited

U.S. PATENT DOCUMENTS 9,278,571 B2 * 3/2016 Abe ..... B65H 31/34
2020/0317462 A1 * 10/2020 Kawakami ..... B65H 37/04

FOREIGN PATENT DOCUMENTS

JP 2015013386 1/2015

* cited by examiner

*Primary Examiner* — Leslie A Nicholson, III
(74) *Attorney, Agent, or Firm* — JCIPRNET

(57) ABSTRACT

A binding device includes a pressing member that has a first tooth, which forms unevenness in a recording material bundle, and a second tooth, which is paired with the first tooth and forms unevenness in the recording material bundle, and presses the recording material bundle with the recording material bundle sandwiched between the first tooth and the second tooth and a control unit that performs control such that pressing is released after a timing when a load on the pressing member decreases from start of pressing of the recording material bundle by the pressing member.

12 Claims, 10 Drawing Sheets

| TIME | INCLINATION | PRESSING TIME AFTER DECREASE |
|---|---|---|
| SHORT | SMALL | FIRST TIME |
| LONG | SMALL | SECOND TIME |
| SHORT | LARGE | SECOND TIME |
| LONG | LARGE | THIRD TIME |

BINDING DEVICE AND IMAGE FORMING SYSTEM

CROSS-REFERENCE TO RELATED APPLICATIONS

This application is based on and claims priority under 35 USC 119 from Japanese Patent Application No. 2019-186735 filed Oct. 10, 2019.

BACKGROUND

(i) Technical Field

The present invention relates to a binding device and an image forming system.

(ii) Related Art

JP2015-013386A discloses a technique of variably controlling a standby time from the transportation of a final sheet of a sheet bundle into a sheet post-processing apparatus to binding.

SUMMARY

In a binding device, a recording material bundle is pressed with the recording material bundle sandwiched between a first tooth and a second tooth which are provided in a pressing member in some cases. In addition, as pressing conditions such as a condition on a force applied to the recording material bundle by the pressing member and a condition on a pressing time for the recording material bundle by the pressing member, there are pressing conditions necessary for securing a binding performance.

Herein, for example, in a case where the pressing member presses the recording material bundle under a certain pressing condition, such as controlling only under a predetermined pressing condition changing according to the number of sheets of recording materials configuring the recording material bundle, the binding performance reduces in some cases.

Aspects of non-limiting embodiments of the present disclosure relate to a binding device and an image forming system that improve a binding performance compared to a case where a pressing member presses a recording material bundle under a certain pressing condition.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a binding device including a pressing member that has a first tooth, which forms unevenness in a recording material bundle, and a second tooth, which is paired with the first tooth and forms unevenness in the recording material bundle, and presses the recording material bundle with the recording material bundle sandwiched between the first tooth and the second tooth and a control unit that performs control such that pressing is released after a timing when a load on the pressing member decreases from start of pressing of the recording material bundle by the pressing member.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the present invention will be described in detail with reference to the accompanying drawings.

Configuration of Image Forming System

Figure 1:
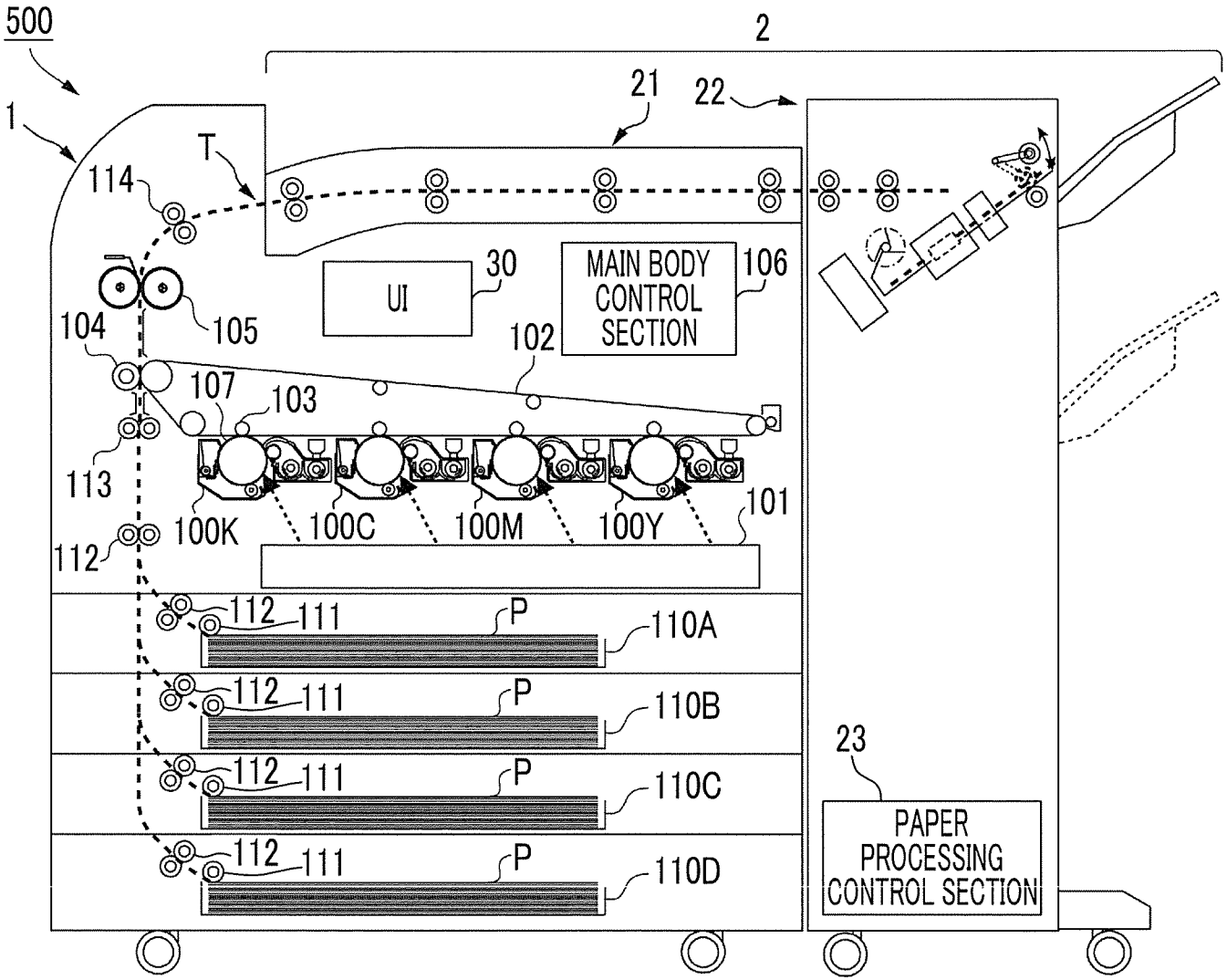
FIG. 1 is a view illustrating a configuration of an image forming system.

FIG. 1 is a view illustrating a configuration of an image forming system 500 to which the exemplary embodiment is applied.

The image forming system 500 illustrated in FIG. 1 includes an image forming apparatus 1 that forms an image on paper P, which is an example of a recording material, and a post-processing apparatus 2 that performs post-processing, such as binding processing, onto the paper P where the image is formed by the image forming apparatus 1.

Examples of the image forming apparatus 1 include a printer and a copier.

The image forming apparatus 1 is provided with four image forming units 100Y, 100M, 100C, and 100K that form an image based on each piece of colored image data. In a case of making description without differentiating between the image forming units 100Y, 100M, 100C, and 100K, the image forming units will be simply referred to as the image forming units 100.

In addition, the image forming apparatus 1 is provided with a laser exposure device 101 that exposes a photoconductor drum 107 provided in each image forming unit 100. Further, the image forming apparatus 1 is provided with an intermediate transfer belt 102 on which a toner image of each color formed by each image forming unit 100 is multiplex-transferred.

In addition, the image forming apparatus 1 is provided with a primary transfer roller 103 that primarily transfers a toner image of each color formed by each image forming unit 100 onto the intermediate transfer belt 102, a secondary transfer roller 104 that secondarily transfers the toner image of each color, which is transferred on the intermediate transfer belt 102, onto the paper P, and a fixing device 105 that fixes the secondarily transferred toner image of each color, onto the paper P. In addition, the image forming apparatus 1 is provided with a main body control section 106 which is configured by a CPU controlled by a program and controls an operation of the image forming apparatus 1.

In addition, the image forming apparatus 1 is provided with a user interface (UI) 30 that displays information for a user. The UI 30 is configured by a display panel. In addition, the UI 30 receives operation from the user.

In each image forming unit 100 of the image forming apparatus 1, a toner image of each color is formed through a step of charging the photoconductor drum 107, a step of forming an electrostatic latent image on the photoconductor drum 107 by scanning exposure from the laser exposure device 101, and a step of developing each colored toner onto the formed electrostatic latent image.

Each colored toner image formed on each image forming unit 100 is primarily transferred onto the intermediate transfer belt 102 by the primary transfer roller 103. Then, with the movement of the intermediate transfer belt 102, each colored toner image is transported to a position where the secondary transfer roller 104 is provided.

On the other hand, different sizes and different types of a plurality of sheets of the paper P are accommodated in each of paper accommodating units 110A to 110D in the image forming apparatus 1.

When forming an image on the paper P, for example, the paper P is taken out of the paper accommodating unit 110A by a pickup roller 111 and is transported one by one to a position of a registration roller 113 by a transport roller 112.

Then, the paper P is supplied from the registration roller 113 at a timing when each colored toner image on the intermediate transfer belt 102 is transported to a position where the secondary transfer roller 104 is disposed.

Accordingly, the respective colored toner images are collectively and secondarily transferred onto the paper P by the action of a transfer electric field formed by the secondary transfer roller 104.

After then, the paper P on which each colored toner image is secondarily transferred is peeled from the intermediate transfer belt 102 and is transported to the fixing device 105. In the fixing device 105, each colored toner image is fixed on the paper P through fixing processing using heat and a pressure to form an image.

Then, the paper P, on which the image is formed, is exited from a paper exit unit T of the image forming apparatus 1 by a transport roller 114 and is supplied to the post-processing apparatus 2.

The post-processing apparatus 2 is disposed on a downstream side of the paper exit unit T of the image forming apparatus 1 and performs binding processing onto the paper on which the image is formed.

Configuration of Post-Processing Apparatus

Figure 2:
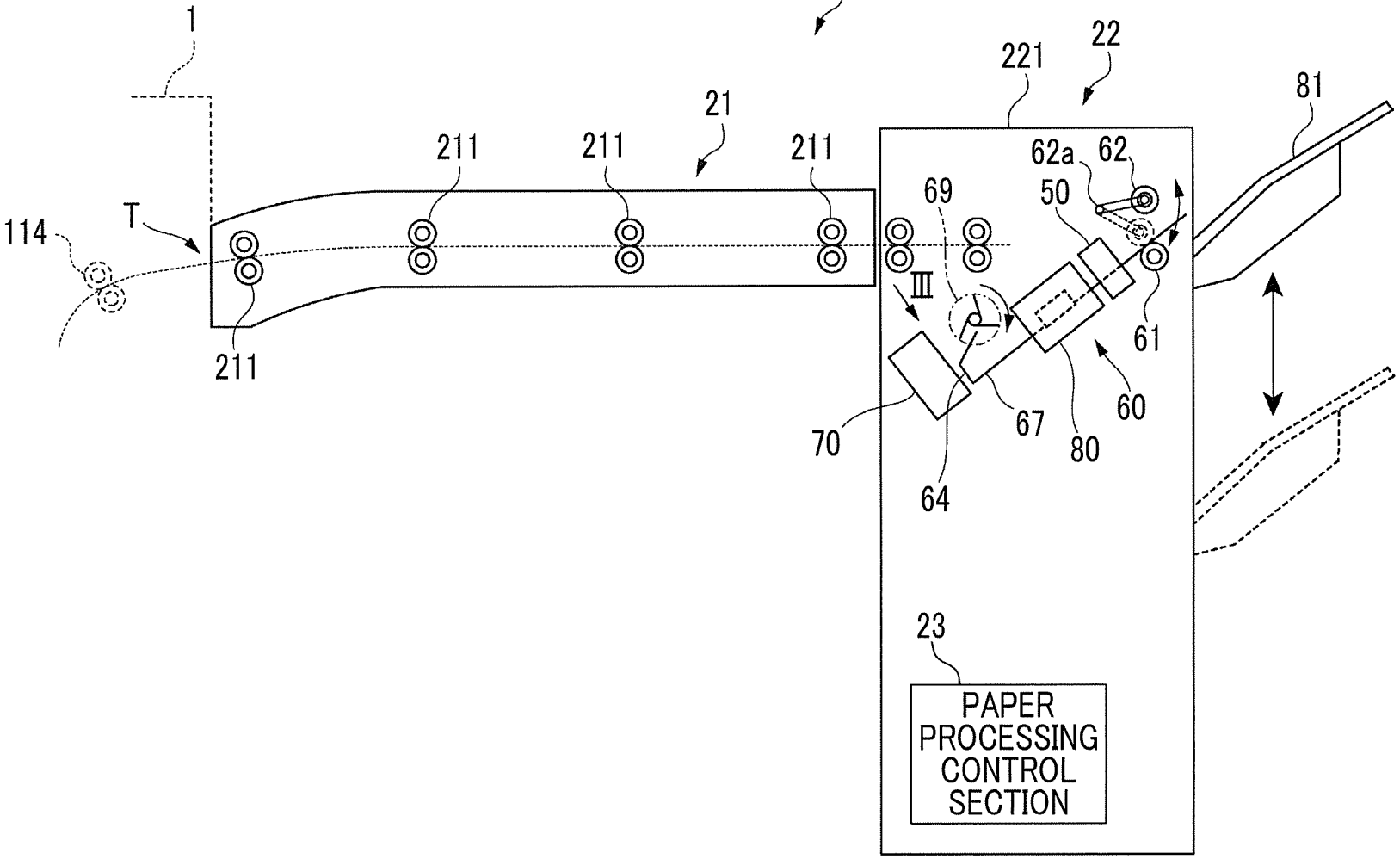
FIG. 2 is a view illustrating a configuration of a post-processing apparatus.

Next, a configuration of the post-processing apparatus 2 will be described. FIG. 2 is a view illustrating the configuration of the post-processing apparatus 2.

The post-processing apparatus 2 is provided with a transport unit 21 connected to the paper exit unit T of the image forming apparatus 1 and a finisher unit 22 that executes predetermined processing onto the paper P transported by the transport unit 21.

In addition, the post-processing apparatus 2 is provided with a paper processing control section 23, which is configured by a CPU controlled by a program and controls each mechanism part of the post-processing apparatus 2. The paper processing control section 23 which is an example of a control unit is connected to the main body control section 106 (refer to FIG. 1) via a signal line (not illustrated), and mutually transmits and receives a control signal.

The transport unit 21 of the post-processing apparatus 2 is provided with a plurality of transport rollers 211 that transport the paper P on which the image is formed by the image forming apparatus 1 toward the finisher unit 22.

The finisher unit 22 is provided with a finisher unit main body 221, a paper stacking unit 60 that stacks a necessary number of sheets of the paper P to generate a paper bundle, and a stapleless binding unit 50 that executes binding processing without using staples onto an end part of the paper bundle generated by the paper stacking unit 60. In addition, the finisher unit 22 is provided with a staple binding unit 70 that executes binding processing using staples onto the end part of the paper bundle generated by the paper stacking unit 60, and a punching unit 80 that executes punching processing onto the end part of the paper bundle generated by the paper stacking unit 60.

In addition, the finisher unit 22 is provided with a transport roller 61 which is rotatably provided and used in transporting the paper bundle generated by the paper stacking unit 60. Further, the finisher unit 22 is provided with a rotary shaft 62*a* that is capable of oscillating with respect to a movement center, and is provided with a movable roller 62 that is movable to a position retracted from the transport roller 61 and to a position pressed against the transport roller 61. In addition, the finisher unit 22 is provided with a stacker 81 onto which the paper bundle transported by the transport roller 61 and the movable roller 62 is stacked. The stacker 81 moves up and down according to the amount of the paper bundle held.

In a case of performing processing by the post-processing apparatus 2, first, the paper P is transported from the image forming apparatus 1 into the transport unit 21 of the post-processing apparatus 2. The paper P transported into the transport unit 21 is sent to the finisher unit 22 by the transport rollers 211.

The paper P sent to the finisher unit 22 is transported to the paper stacking unit 60. Specifically, the paper P falls to the paper stacking unit 60 after being transported to above the paper stacking unit 60. Then, the paper P is supported from below by a support plate 67 provided in the paper stacking unit 60. Further, the paper P moves in a sliding manner on the support plate 67 by an inclined and rotating paddle 69 that is given to the support plate 67.

After then, the paper P abuts against an end guide 64 attached to an end part of the support plate 67. Accordingly, the movement of the paper is stopped in the exemplary embodiment.

Thereafter, this operation is performed each time the paper P is transported from an upstream side, and a paper bundle in a state where trailing end parts of sheets of the paper P are aligned is generated on the paper stacking unit 60. This paper bundle is regarded as a recording material bundle.

In a case where a predetermined number of sheets of the paper P is stacked on the support plate 67 and a paper bundle is generated on the support plate 67, post-processing is executed onto the paper bundle using the stapleless binding unit 50, the staple binding unit 70, and the punching unit 80. In the exemplary embodiment, the predetermined number of sheets is set according to the post-processing, such as 10 sheets for the stapleless binding unit 50, 50 sheets for the staple binding unit 70, and 70 sheets for the punching unit 80.

In a case where the post-processing on the paper bundle ends, the movable roller 62 advances toward the transport roller 61, and the paper bundle is sandwiched between the movable roller 62 and the transport roller 61. After then, the transport roller 61 and the movable roller 62 are driven to rotate, and the paper bundle on which the binding processing is executed is transported to the stacker 81.

Figure 3:
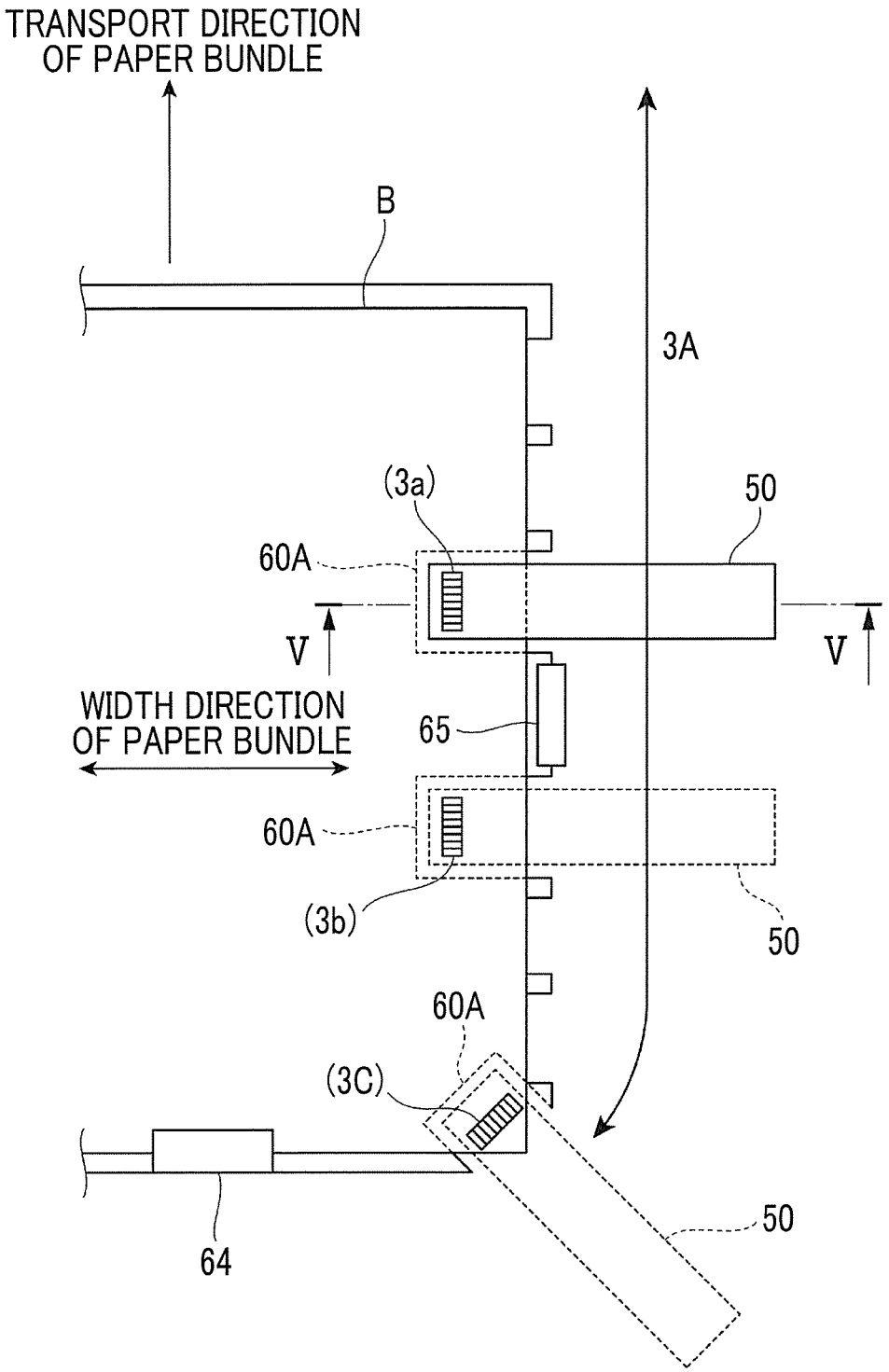
FIG. 3 is a view in a case where a stapleless binding unit is seen from an arrow III direction of FIG. 2.

FIG. 3 is a view in a case where the stapleless binding unit 50 is seen from an arrow III direction of FIG. 2.

The paper stacking unit 60 is provided with alignment members 65. Although a part thereof is not illustrated, the alignment members 65 are provided at both end parts in a width direction of the paper stacking unit 60. Each time the paper P is stacked on the paper stacking unit 60, the alignment members 65 are pressed against the sides of the paper P and align positions of end parts of the paper P. In addition, the alignment members 65 move in a width direction of a paper bundle B, and move the paper bundle B in a width direction of the paper bundle B.

As shown with an arrow 3A of FIG. 3, the stapleless binding unit 50 is provided to be movable in a transport direction of the paper bundle B. Then, the stapleless binding unit 50 performs binding processing at a plurality of locations in the transport direction of the paper bundle B at the moved positions, for example, a region (3*a*) and a region (3*b*) of the paper bundle B. In addition, the stapleless binding unit 50 moves to the vicinity of a corner of the paper bundle B, and performs binding processing onto the corner of the paper bundle B indicated with a region (3*c*) of the paper bundle B.

The stapleless binding unit 50 moves linearly between a position for binding the region (3*a*) and a position for binding the region (3*b*) of the paper bundle B. On the other hand, between the position for binding the region (3*b*) and the position for binding the region (3*c*) of the paper bundle B, the stapleless binding unit 50 moves while rotating by, for example, 45°.

The paper stacking unit 60 is provided with a plurality of notches 60A. Accordingly, interference between the stapleless binding unit 50 and the paper stacking unit 60 is avoided.

Configuration of Stapleless Binding Unit

Figure 4:
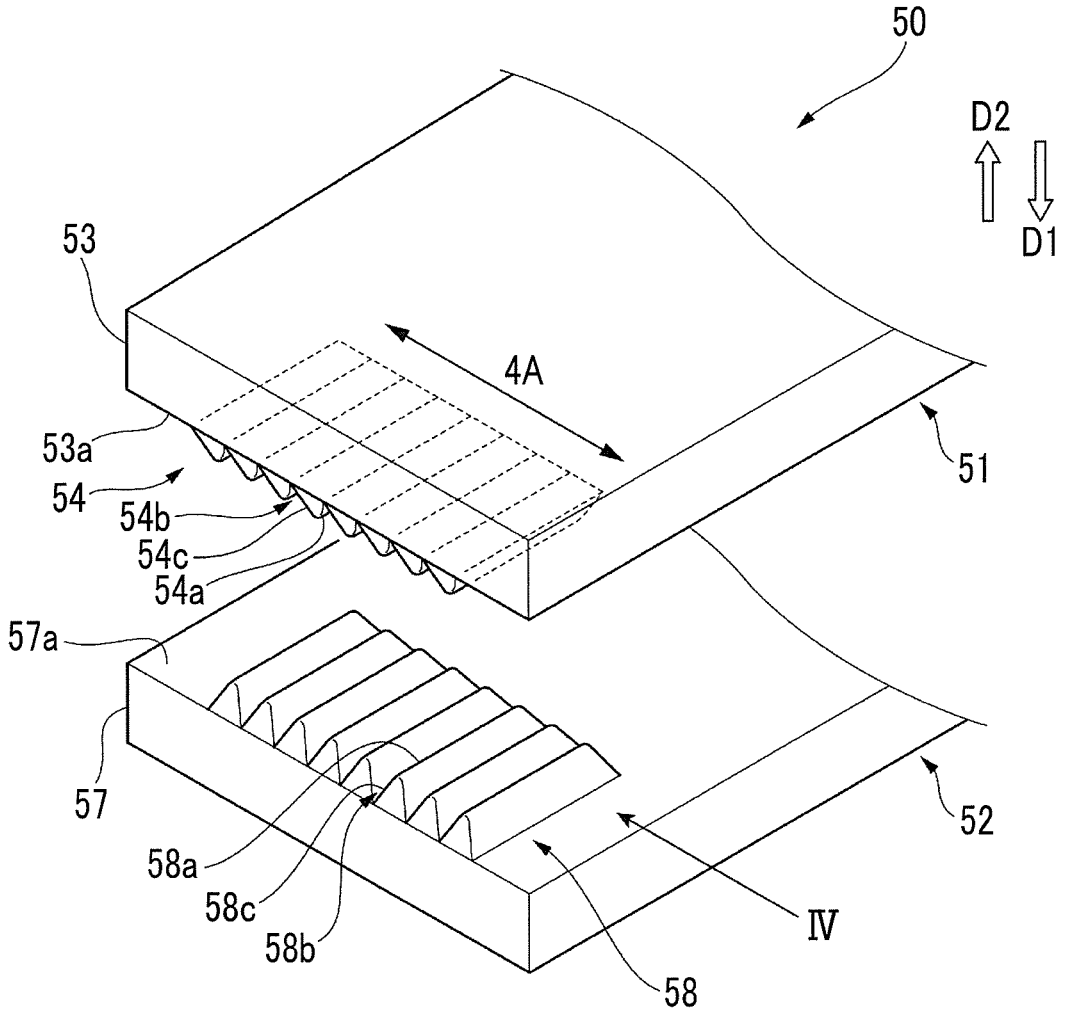
FIG. 4 is a perspective view illustrating a configuration of the stapleless binding unit 50.
Figure 5A:
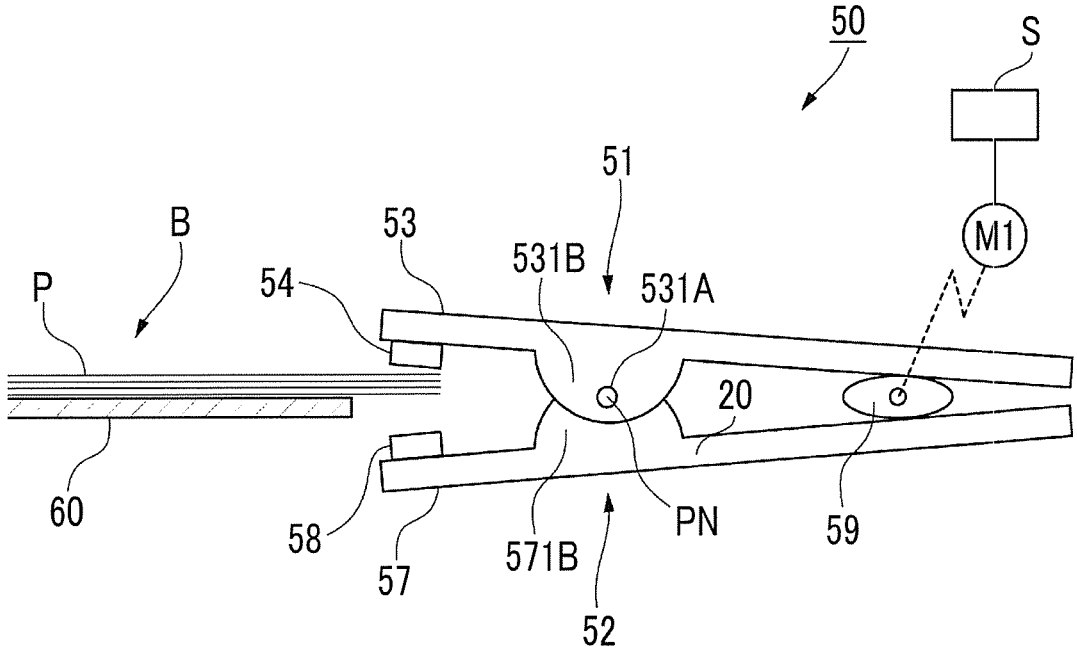
FIGS. 5A and 5B are cross-sectional views taken along Line V-V of FIG. 3.
Figure 5B:
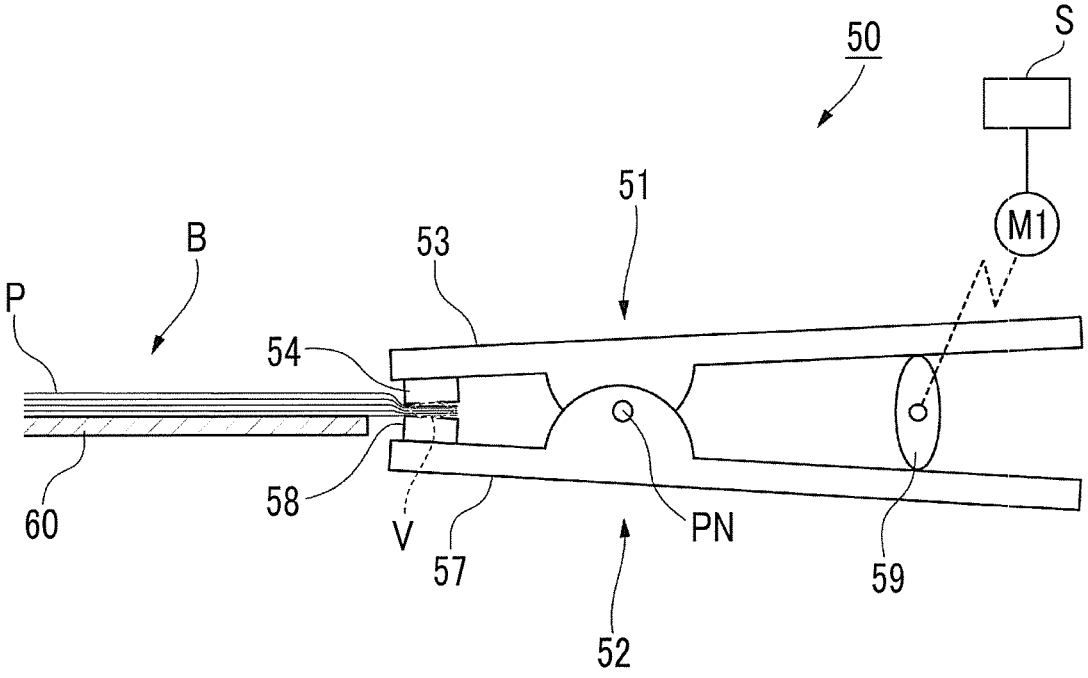

Next, a configuration of the stapleless binding unit 50 will be described. FIG. 4 is a perspective view illustrating the configuration of the stapleless binding unit 50. In addition, FIGS. 5A and 5B are cross-sectional views taken along line V-V of FIG. 3.

As illustrated in FIG. 4, the stapleless binding unit 50, which is an example of a binding device, is provided with an upper pressing member 51. In addition, the stapleless binding unit 50 is provided with a lower pressing member 52 that is paired with the upper pressing member 51 and is disposed to face the upper pressing member 51.

The upper pressing member 51 is provided to be able to advance and retreat with respect to the lower pressing member 52 (refer to arrows D1 and D2 in FIG. 4).

The upper pressing member 51 is provided with an upper base part 53 and an upper uneven part 54 protruding from the upper base part 53. The upper uneven part 54 is provided to extend along one direction (arrow 4A direction in FIG. 4).

The upper uneven part 54, which is an example of a first tooth, is provided with a plurality of upper protruding portions 54*a*, a plurality of upper recessed portions 54*b*, and a plurality of upper connecting surfaces 54*c*.

The plurality of upper protruding portions 54*a*, which are an example of a first protruding portion, are arranged in a longitudinal direction of the upper uneven part 54. In addition, the upper protruding portions 54*a* protrude downward from a surface 53*a* of the upper base part 53. In addition, the upper protruding portions 54*a* are formed along a transverse direction of the upper uneven part 54 (direction intersecting the longitudinal direction of the upper uneven part 54).

The upper recessed portion 54*b*, which is an example of a first recessed portion, is formed between the two adjacent upper protruding portions 54*a* in the longitudinal direction of the upper uneven part 54. In addition, the upper protruding portions 54*a* and the upper recessed portions 54*b* are alternately disposed in the longitudinal direction of the upper uneven part 54.

The upper connecting surfaces 54*c* are surfaces that connect the upper protruding portions 54*a* to the upper recessed portions 54*b* which are provided next to the upper protruding portions 54*a*.

The lower pressing member 52 is provided with a lower base part 57 and a lower uneven part 58 protruding from the lower base part 57. The lower uneven part 58 is provided to extend along the longitudinal direction of the upper uneven part 54.

The lower uneven part 58, which is an example of the second tooth, is provided with a plurality of lower protruding portions 58*a*, a plurality of lower recessed portions 58*b*, and a plurality of lower connecting surfaces 58*c*.

The plurality of lower protruding portions 58*a*, which are an example of a second protruding portion, are arranged in a longitudinal direction of the lower uneven part 58. In addition, the lower protruding portions 58*a* protrude upward from a surface 57*a* of the lower base part 57. In addition, the lower protruding portions 58*a* are formed along a transverse direction of the lower uneven part 58 (direction intersecting the longitudinal direction of the lower uneven part 58).

The lower recessed portion 58*b*, which is an example of a second recessed portion, is formed between the two adjacent lower protruding portions 58*a* in the longitudinal direction of the lower uneven part 58. In addition, the lower protruding portions 58*a* and the lower recessed portions 58*b* are alternately disposed in the longitudinal direction of the lower uneven part 58.

The lower connecting surfaces 58*c* are surfaces that connect the lower protruding portions 58*a* to the lower recessed portions 58*b* which are provided next to the lower protruding portions 58*a*.

The upper uneven part 54 of the upper pressing member 51 meshes with the lower uneven part 58 of the lower pressing member 52 via the paper bundle B (refer to FIG. 3), thereby pressing the paper bundle B and forming unevenness on the paper bundle B. Herein, the upper pressing member 51 and the lower pressing member 52 are regarded as pressing members that press the paper bundle B with the paper bundle sandwiched between the upper uneven part 54 and the lower uneven part 58.

In addition, as illustrated in FIG. 5A, the stapleless binding unit 50 is provided with an elliptical cam 59 that is disposed between the upper pressing member 51 and the lower pressing member 52 and a cam motor M1 that drives the cam 59 by receiving the supply of a current from a power supply (not illustrated) and rotating.

Further, the stapleless binding unit 50 is provided with a monitor S for monitoring a value of the current supplied to the cam motor M1. The monitor S which is an example of a detecting unit measures the value of the current supplied from the power supply to the cam motor M1. Then, information related to the measured current value is transmitted to the paper processing control section 23.

The upper base part 53 of the upper pressing member 51 is provided with a protrusion 531B protruding toward a lower pressing member 52 side, and a through-hole 531A is formed in the protrusion 531B.

The lower base part 57 of the lower pressing member 52 is provided with a protrusion 571B protruding toward an upper pressing member 51 side, and a through-hole (not illustrated) is formed in the protrusion 571B.

In addition, in the exemplary embodiment, a pin PN passes through the through-hole 531A provided in the upper pressing member 51 and the through-hole provided in the lower pressing member 52. In the exemplary embodiment, the upper base part 53 and the lower base part 57 oscillate with the pin PN as a center.

Further, in the exemplary embodiment, the upper uneven part 54 and the lower uneven part 58 are provided on a paper bundle B side from the pin PN, and the cam 59 is provided on an opposite side to a side where the paper bundle B is provided with the pin PN interposed therebetween.

In the exemplary embodiment, in a case where the cam 59 rotates by receiving a rotational force of the cam motor M1, as illustrated in FIG. 5B, the upper uneven part 54 and the lower uneven part 58 move closer to each other, and the paper bundle B is sandwiched between the upper uneven part 54 and the lower uneven part 58, thereby applying a pressure to the paper bundle B. Accordingly, fibers of the paper P configuring the paper bundle B are entangled, and the adjacent sheets of the paper P are joined to each other, thereby forming a binding portion V that binds the plurality of sheets of paper P. Rotation of the cam motor M1 in a direction where the upper uneven part 54 and the lower uneven part 58 come closer to each other will be referred to as forward rotation hereinafter. In addition, the cam motor M1 is regarded as a driving unit that drives the upper pressing member 51 and the lower pressing member 52 by a driving force.

In addition, in a case where the cam 59 rotates by receiving a rotational force caused by reverse rotation of the cam motor M1, the upper uneven part 54 and the lower uneven part 58 move away from each other. Accordingly, the pressing of the paper bundle B by the upper uneven part 54 and the lower uneven part 58 is released. Herein, the reverse rotation is rotation in a reverse direction with respect to the forward rotation.

A specific configuration of the stapleless binding unit 50, in particular, a mechanism for causing the paper bundle B to be sandwiched by bringing the upper uneven part 54 and the lower uneven part 58 closer to each other is not limited to the configuration described with reference to FIGS. 5A and 5B. Various configurations which can pressurize the paper bundle B with the paper bundle sandwiched between the upper uneven part 54 and the lower uneven part 58 can be adopted as the mechanism for causing the paper bundle B to be sandwiched by bringing the upper uneven part 54 and the lower uneven part 58 closer to each other.

Relationship Between Pressing Member and Paper Bundle in Binding Processing

Next, a relationship between the upper pressing member 51 and the lower pressing member 52 and the paper bundle B in binding processing of the stapleless binding unit 50 will be described.

Figure 6A:
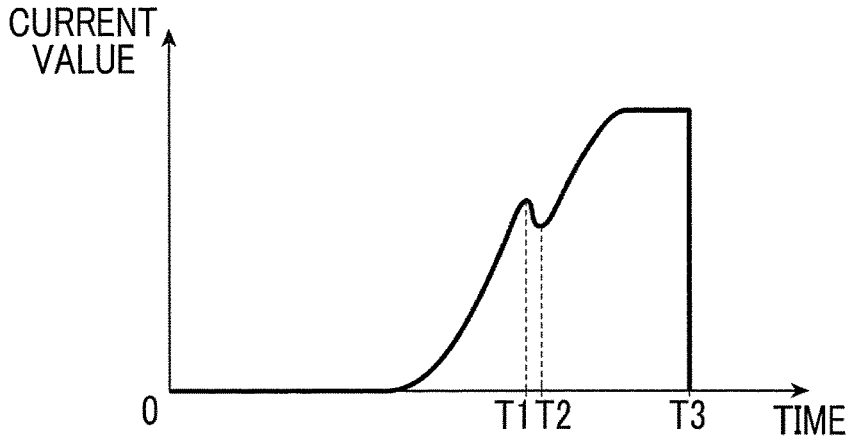
FIG. 6A is a graph showing a relationship between a time elapsed after start of binding processing by the stapleless binding unit and a value of a current supplied to a cam motor.
Figure 6B:
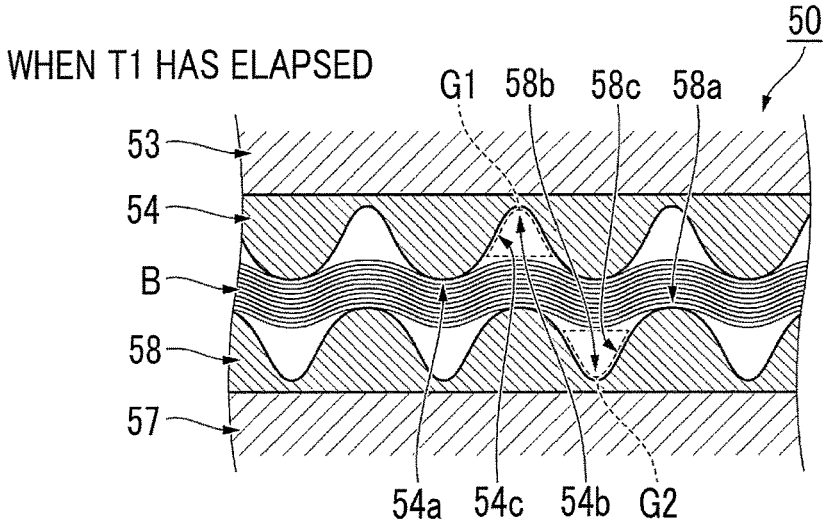
FIG. 6B is a view illustrating a relationship between an upper pressing member and a lower pressing member and a paper bundle when a time T1 has elapsed.
Figure 6C:
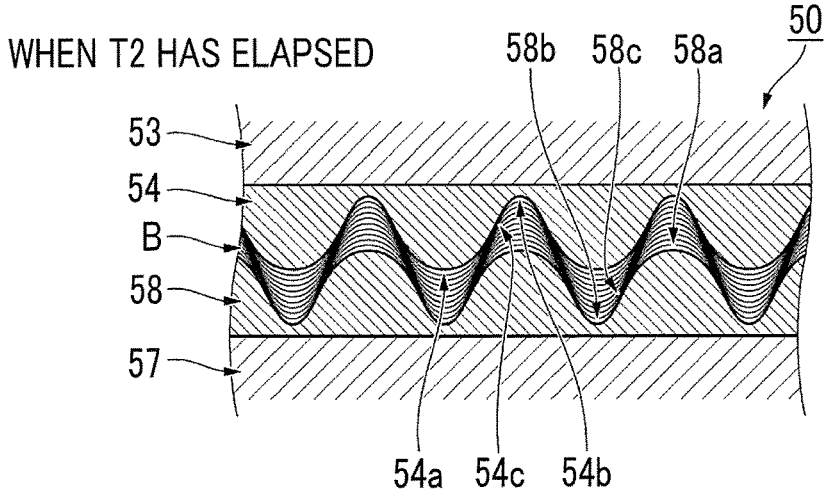
FIG. 6C is a view illustrating a relationship between the upper pressing member and the lower pressing member and the paper bundle when a time T2 has elapsed.

FIG. 6A is a graph showing a relationship between a time elapsed after the stapleless binding unit 50 has started binding processing and a value of a current supplied to the cam motor M1 (refer to FIGS. 5A and 5B). FIG. 6B is a view illustrating a relationship between the upper pressing member 51 and the lower pressing member 52 and the paper bundle B when a time T1 has elapsed. In addition, FIG. 6C is a view illustrating a relationship between the upper pressing member 51 and the lower pressing member 52 and the paper bundle B when a time T2 has elapsed.

In the binding processing of the stapleless binding unit 50, the upper pressing member and the lower pressing member come into contact with the paper bundle B and the pressing of the paper bundle B starts as the upper pressing member 51 and the lower pressing member 52 come closer to each other. After then, as a time elapses, the upper pressing member 51 and the lower pressing member 52 gradually come closer to each other and press the paper bundle B.

The paper processing control section 23 performs control such that a driving force necessary for bringing the upper pressing member 51 and the lower pressing member 52 closer to each other is applied to the upper pressing member 51 and the lower pressing member 52. More specifically, the paper processing control section 23 performs control such that a current necessary for bringing the upper pressing member 51 and the lower pressing member 52 closer to each other is supplied to the cam motor M1. In addition, the longer a time for which the current is supplied to the cam motor M1, the closer the upper pressing member 51 and the lower pressing member 52 come to each other. For this reason, the longer the time for which the current is supplied to the cam motor M1, the larger a deformation amount of a bound portion of the paper bundle B.

Herein, in a case where the paper bundle B is sandwiched between the upper pressing member 51 and the lower pressing member 52, the upper pressing member and the lower pressing member receive a reaction force from the paper bundle B. However, the larger the reaction force, the larger the value of the current necessary to be supplied to the cam motor M1 in order to bring the upper pressing member 51 and the lower pressing member 52 closer to each other. For this reason, in a case where the reaction force received by the upper pressing member 51 and the lower pressing member 52 from the paper bundle B increases with the elapse of time, the value of the current supplied to the cam motor M1 also increases with the elapse of time. In addition, as the reaction force of the paper bundle B increases, a load applied to the upper pressing member 51 and the lower pressing member 52 increases.

Hereinafter, a case where the paper processing control section 23 controls the binding processing by pressing the paper bundle B against the upper pressing member 51 and the lower pressing member 52 for a predetermined time will be described.

In a case where the binding processing of the stapleless binding unit 50 is started, first, the cam motor M1 rotates by receiving the supply of the current, and rotates the cam 59. In a case where the cam 59 rotates, as described above, the upper uneven part 54 of the upper pressing member 51 and the lower uneven part 58 of the lower pressing member 52 come closer to each other, and the upper uneven part 54 and the lower uneven part 58 come into contact with the paper bundle B, thereby applying a pressure to the paper bundle B.

In a case where the pressure is applied to the paper bundle B, a reaction force of the paper bundle B is generated. However, as the value of the current supplied to the cam motor M1 increases, the upper uneven part 54 and the lower uneven part 58 come even closer to each other. In addition, in a case where the paper bundle B is sandwiched and stretched between the upper uneven part 54 and the lower uneven part 58 as the upper uneven part 54 and the lower uneven part 58 come closer to each other, the reaction force of the paper bundle B also increases, and the load applied to the upper uneven part 54 and the lower uneven part 58 increases as well. In this way, as shown in FIG. 6A, the value of the current supplied to the cam motor M1 increases with the elapse of time, after the binding processing is started.

In a case where the time T1 elapses from the start of the binding processing, a relationship between the upper pressing member 51 and the lower pressing member 52 and the paper bundle B is as illustrated in FIG. 6B. At this time, the paper bundle B is sandwiched and stretched between the upper uneven part 54 and the lower uneven part 58, and is deformed into a shape following the upper protruding portions 54*a* and the lower protruding portions 58*a*. On the other hand, a gap G1 is formed between the paper bundle B and the upper recessed portion 54*b*, and the paper bundle B is not deformed into a shape following the upper uneven part 54. In other words, the paper bundle B is not in a state following the upper connecting surfaces 54*c*. In addition, a gap G2 is formed between the paper bundle B and the lower recessed portions 58*b*, and the paper bundle B is not deformed into a shape following the lower uneven part 58. In other words, the paper bundle B is not in a state following the lower connecting surfaces 58*c*.

Then, the upper uneven part 54 and the lower uneven part 58 come even closer to each other, the paper bundle B is further stretched, and some of the fibers configuring each sheet of paper of the paper bundle B break. Ina case where this breakage occurs, the reaction force of the paper bundle B decreases, and the load applied to the upper uneven part 54 and the lower uneven part 58 decreases. For this reason, as shown in FIG. 6A, immediately after the elapse of the time T1, the value of the current supplied to the cam motor M1 for bringing the upper uneven part 54 and the lower uneven part 58 closer to each other decreases. In addition, at this time, the paper bundle B is further pushed into the upper uneven part 54 and the lower uneven part 58.

In a case where the time T2 elapses from the start of the binding processing, the relationship between the upper pressing member 51 and the lower pressing member 52 and the paper bundle B is as illustrated in FIG. 6C. At this time, the paper bundle B has entered the gap G1 and the gap G2 formed when the time T1 has elapsed (refer to FIG. 6B), and the fibers of each sheet of paper of which entanglement is loosened by the breakage in the paper bundle B start to entangle. Accordingly, the paper bundle B deforms into the shape following the upper uneven part 54 and the lower uneven part 58. In other words, the paper bundle B is in a state following the upper connecting surfaces 54*c* and the lower connecting surfaces 58*c*.

After then, in a case where the paper bundle B receives the pressing force of the upper uneven part 54 and the lower uneven part, the reaction force of the paper bundle B increases again. However, as the value of the current supplied to the cam motor M1 increases, the upper uneven part 54 and the lower uneven part 58 come even closer to each other, and the pressing of the paper bundle B is continued. Then, in a case where a time T3 (refer to FIG. 6A) corresponding to a predetermined time for which the upper pressing member 51 and the lower pressing member 52 press the paper bundle B elapses, the supply of the current to the cam motor M1 ends. Accordingly, the pressing of the paper bundle B by the upper pressing member 51 and the lower pressing member 52 is released.

As described above, in the binding processing using the stapleless binding unit 50, the binding of the paper bundle B is performed as the upper pressing member 51 and the lower pressing member 52 take time to press the paper bundle B. Herein, as a pressing time for the upper pressing member 51 and the lower pressing member 52, there is a pressing time necessary for securing a binding performance, and this pressing time varies according to the number of sheets of paper configuring the paper bundle B to be subjected to the binding processing. For this reason, in a case where the paper bundle B is pressed for a certain pressing time regardless of the number of sheets of paper configuring the paper bundle B to be subjected to binding, the binding performance reduces in some cases according to the number of sheets of paper configuring the paper bundle B. The pressing time is a time for which the upper pressing member 51 and the lower pressing member 52 press the paper bundle B.

For example, in a case where the number of sheets of paper configuring the paper bundle B is small, a pressing time necessary for performing the binding of the paper bundle B is short. On the other hand, in a case where the number of sheets of paper configuring the paper bundle B is large, the pressing time necessary for performing the binding of the paper bundle B is long.

Thus, in a case where the binding processing is performed onto the paper bundle B with a small number of sheets of paper, the same pressing time as the time for performing binding of the paper bundle B with a large number of sheets of paper is set, and more load is continued to be applied than necessary, a time required for binding becomes longer than necessary and productivity falls, or the bound portion of the paper bundle B breaks in some cases. In addition, in a case where the binding processing is performed onto the paper bundle B with a large number of sheets of paper and the same pressing time as the time for performing binding of the paper bundle B with a small number of sheets of paper is set, the pressing of the paper bundle B is insufficient and binding is incomplete in some cases.

On the contrary, in the exemplary embodiment, the paper processing control section 23 performs control such that a pressing time corresponds to the paper bundle B to be subjected to the binding processing. More specifically, the paper processing control section 23 performs control such that pressing by the upper pressing member 51 and the lower pressing member 52 is released after a timing when a load applied to the upper pressing member 51 and the lower pressing member 52 from the start of the binding processing decreases.

In a case of performing binding of the paper bundle B using the stapleless binding unit 50, the binding of the paper bundle B is performed, after the paper bundle B is pressed and some of fibers configuring each sheet of paper of the paper bundle B break, as the paper bundle B is further pressed and the fibers of each sheet of paper of which entanglement is loosened by the breakage in the paper bundle B entangle. Herein, as described above, at a timing when a load applied to the upper pressing member 51 and the lower pressing member 52 decreases, the fibers of each sheet of paper of which entanglement is loosened by the breakage in the paper bundle B start to entangle.

Thus, as the pressing of the paper bundle B is continued until after the timing when the load applied to the upper pressing member 51 and the lower pressing member 52 decreases in the exemplary embodiment, a pressing time is secured until the fibers of each sheet of paper of which entanglement is loosened by the breakage in the paper bundle B entangle. In other words, in the exemplary embodiment, the pressing of the paper bundle B is continued until after a timing when the paper bundle B is pressed by the upper pressing member 51 and the lower pressing member 52 and the paper bundle B comes into a state following the upper connecting surfaces 54*c* and the lower connecting surfaces 58*c*.

Binding Control Processing

Next, binding control processing will be described. The binding control processing is processing of controlling the binding processing for the paper bundle B by the stapleless binding unit 50. The binding control processing is performed under the control of the paper processing control section 23. In addition, in a case where the paper processing control section 23 is instructed to execute the binding processing using the stapleless binding unit 50, the binding control processing is started.

Figure 7:
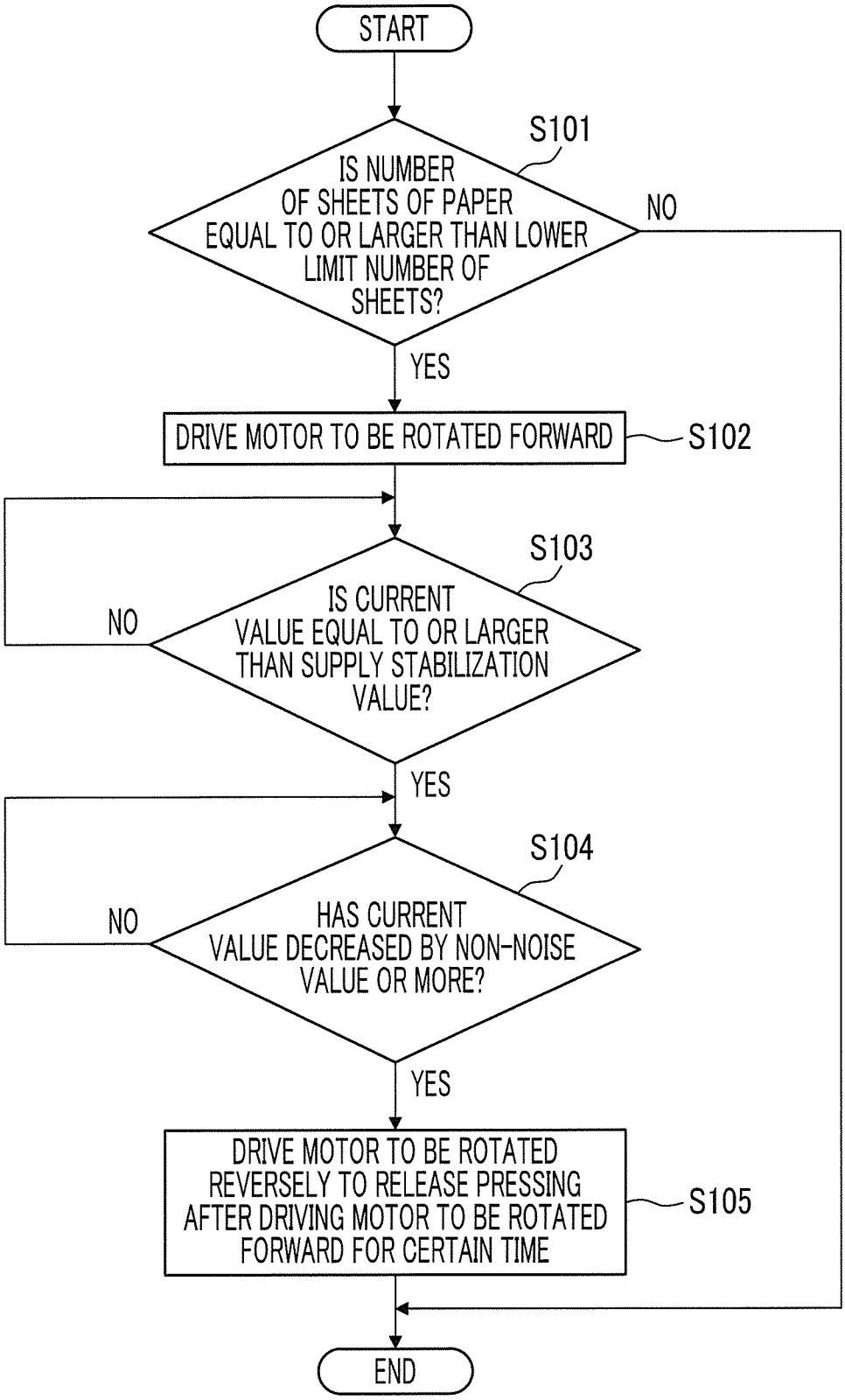
FIG. 7 is a flowchart showing flow of binding control processing.

FIG. 7 is a flowchart showing the flow of the binding control processing.

First, the paper processing control section 23 determines whether or not the number of sheets of paper configuring the paper bundle B to be subjected to binding processing is equal to or larger than a lower limit number of sheets (S101). The lower limit number of sheets is a lower limit value of the number of sheets of paper for determining that it is necessary to set a pressing time according to the paper bundle B to be subjected to binding processing. The lower limit number of sheets is regarded as a predetermined first number of sheets. Any number of sheets may be the lower limit number of sheets, for example, five sheets. In the exemplary embodiment, an increase in the efficiency of binding processing is achieved by performing control such that a pressing time is set in a case of performing the binding of the paper bundle B with eight sheets of paper, which is a larger number of sheets than five sheets, and a uniform pressing time is set in a case of performing the binding of the paper bundle B with three sheets of paper, which is a smaller number of sheets than five sheets.

In a case where the number of sheets of paper configuring the paper bundle B is smaller than lower limit number of sheets (NO in S101), the binding control processing ends. In this case, the paper processing control section 23 performs the binding processing for the paper bundle B as the stapleless binding unit 50 presses the paper bundle B for a predetermined time. The predetermined time is set regardless of the number of sheets of paper configuring the paper bundle B to be subjected to binding processing.

On the other hand, in a case where the number of sheets of paper configuring the paper bundle B is equal to or larger than the lower limit number of sheets (YES in S101), the paper processing control section 23 supplies a current to the cam motor M1 such that the cam motor M1 is driven to be rotated forward (S102). Accordingly, the upper pressing member 51 and the lower pressing member 52 come closer to each other, and the pressing of the paper bundle B by the upper pressing member 51 and the lower pressing member 52 is started.

The paper processing control section 23 determines whether or not a value of the current supplied to the cam motor M1 is equal to or larger than a supply stabilization value (S103). The supply stabilization value is a value for determining that the supply of the current to the cam motor M1 is stabilized. The supply stabilization value may be any value, but is, for example, 1 A. Herein, the monitor S (refer to FIGS. 5A and 5B) measures the value of the current supplied to the cam motor M1, and transmits a signal to the paper processing control section 23 in a case where the measured current value is equal to or larger than the supply stabilization value. The paper processing control section 23 makes the determination described above based on whether or not this signal has been received. While a negative result continues, the paper processing control section 23 continues the processing of Step S103.

On the other hand, in a case where the value of the current supplied to the cam motor M1 is equal to or larger than the supply stabilization value (YES in S103), the paper processing control section 23 determines whether or not the value of the current supplied to cam motor M1 has decreased by a non-noise value or more (S104). The non-noise value is a value for determining that the decrease in the value of the current supplied to the cam motor M1 is not caused by noise of the power supply. This non-noise value is, for example, 0.5 A. Herein, the monitor S detects that a load applied to the upper pressing member 51 and the lower pressing member 52 has decreased in a case where the value of the current supplied to the cam motor M1 has decreased by the non-noise value or more. In a case where the monitor S detects the decrease in the load applied to the upper pressing member 51 and the lower pressing member 52, the monitor S transmits a signal to the paper processing control section 23. The paper processing control section 23 makes the determination described above based on whether or not this signal has been received. While the negative result continues, the paper processing control section 23 continues the processing of Step S104.

In a case where the value of the current supplied to the cam motor M1 decreases by the non-noise value or more (YES in S104), the processing proceeds to the next step.

The paper processing control section 23 supplies the current to the cam motor M1 for a certain time such that the cam motor M1 is driven to be rotated forward, and the pressing of the paper bundle B by the upper pressing member 51 and the lower pressing member 52 is continued. After then, the paper processing control section 23 drives the cam motor M1 to be rotated reversely to release the pressing of the paper bundle B by the upper pressing member 51 and the lower pressing member 52 (S105). Herein, the certain time is a time determined as a time necessary for binding for the paper bundle B to be completed from the decrease in the load applied to the upper pressing member 51 and the lower pressing member 52 after the start of the pressing of the paper bundle B by the upper pressing member 51 and the lower pressing member 52. The certain time is set regardless of the number of sheets of paper configuring the paper bundle B to be subjected to binding processing.

As described above, in the exemplary embodiment, the paper processing control section 23 performs control such that the pressing is released after a timing when the load on the upper pressing member 51 and the lower pressing member 52 decreases from the start of the pressing of the paper bundle B by the upper pressing member 51 and the lower pressing member 52. More specifically, in the exemplary embodiment, the paper processing control section 23 performs control such that the pressing is released after a timing when the decrease in the load on the upper pressing member 51 and the lower pressing member 52 is detected by the monitor S. In other words, in the exemplary embodiment, the paper processing control section 23 performs control such that the paper bundle B is pressed by the upper pressing member 51 and the lower pressing member 52 and the pressing is released after a timing when the paper bundle B follows surfaces formed from the upper recessed portions 54*b* to the upper protruding portions 54*a* of the upper uneven part 54. Herein, the surfaces formed from the upper recessed portions 54*b* to the upper protruding portions 54*a* are, for example, the upper connecting surfaces 54*c*.

In addition, in the exemplary embodiment, the monitor S detects the decrease in the value of the current supplied to the cam motor M1. In particular, in the exemplary embodiment, in a case where the value of the current supplied to the cam motor M1 has decreased by 0.5 A or more, the monitor S detects the decrease in the load on the upper pressing member 51 and the lower pressing member 52.

In addition, in the exemplary embodiment, in a case where the number of sheets of paper of the paper bundle B is larger than the lower limit number of sheets, the pressing is controlled to be released after the timing when the load on the upper pressing member 51 and the lower pressing member 52 decreases.

Modification Example

Next, Modification Example of the binding control processing will be described.

Figure 8:
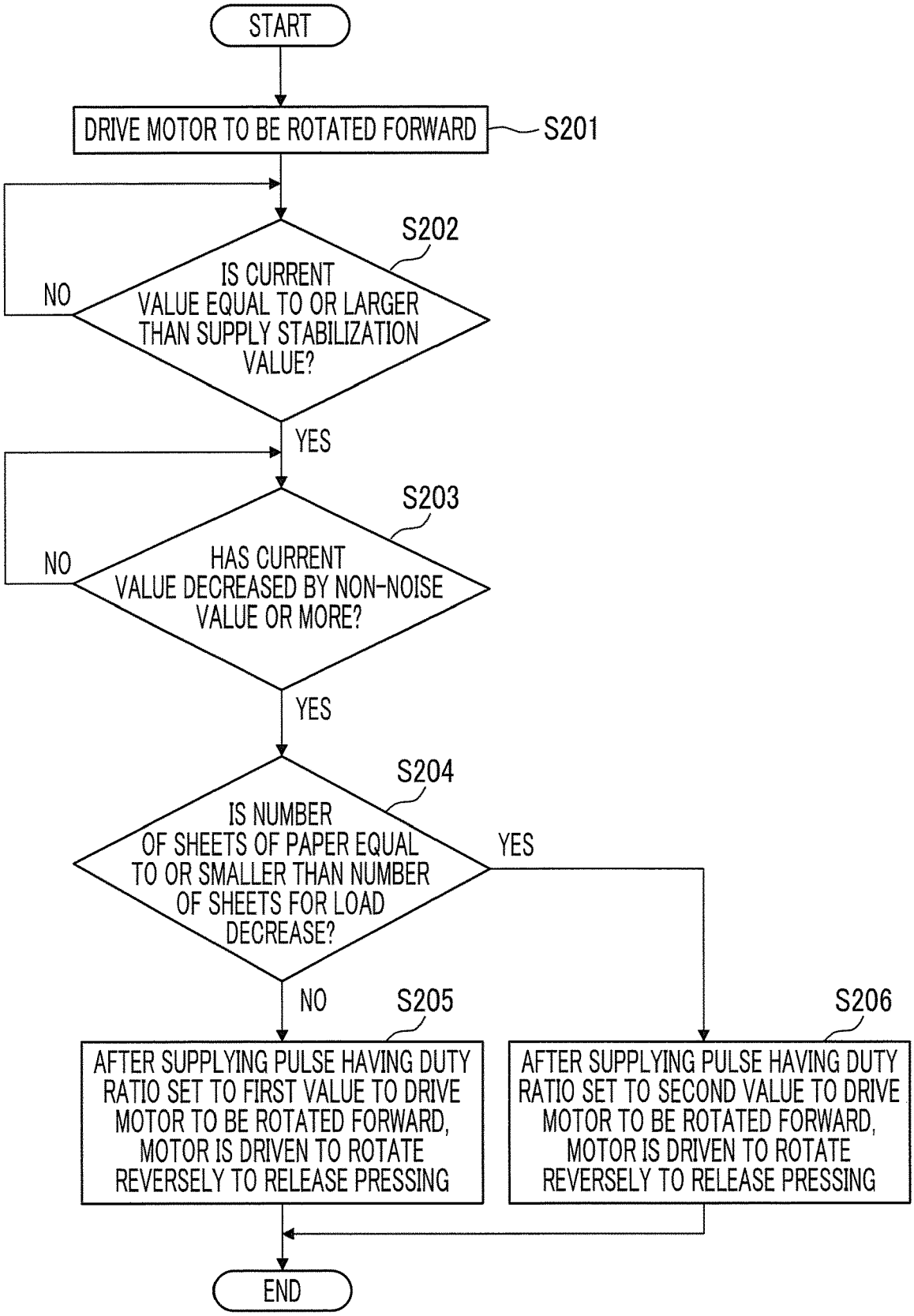
FIG. 8 is a flowchart showing flow of binding control processing of Modification Example.

FIG. 8 is a flowchart showing the flow of the binding control processing of Modification Example.

First, the paper processing control section 23 performs the processing of Steps S201 to S203. Steps S201 to S203 are processing identical to the processing of Steps S102 to S104 of the binding control processing shown in FIG. 7.

In a case where the value of the current supplied to the cam motor M1 decreases by the non-noise value or more (YES in S203), the paper processing control section 23 determines whether or not the number of sheets of paper configuring the paper bundle B to be subjected to binding processing is equal to or smaller than the number of sheets for load decrease (S204). The number of sheets for load decrease is a threshold value of the number of sheets of paper for determining that it is necessary to decrease a load applied to the paper bundle B caused by pressing by the upper pressing member 51 and the lower pressing member 52. The number of sheets for load decrease may be any number of sheets, but is, for example, three sheets. In addition, the number of sheets for load decrease is regarded as a predetermined second number of sheets.

In a case where the number of sheets of paper configuring the paper bundle B is larger than the number of sheets for load decrease (NO in S204), processing proceeds to the next step.

The paper processing control section 23 supplies a pulse having a duty ratio set to a first value for a certain time such that the cam motor M1 is driven to be rotated forward, and the pressing of the paper bundle B by the upper pressing member 51 and the lower pressing member 52 is continued. After then, the paper processing control section 23 drives the cam motor M1 to be rotated reversely to release the pressing of the paper bundle B by the upper pressing member 51 and the lower pressing member 52 (S205). The duty ratio is a ratio of a pulse width to a pulse period. The first value is, for example, 0.5.

In addition, in a case where the number of sheets of paper configuring the paper bundle B is equal to or smaller than the number of sheets for load decrease (YES in S204), processing proceeds to Step S206.

The paper processing control section 23 supplies a pulse having a duty ratio set to a second value for a certain time such that the cam motor M1 is driven to be rotated forward, and the pressing of the paper bundle B by the upper pressing member 51 and the lower pressing member 52 is continued. After then, the paper processing control section 23 drives the cam motor M1 to be rotated reversely to release the pressing of the paper bundle B by the upper pressing member 51 and the lower pressing member 52 (S206). Herein, the second value is a value smaller than the first value. The second value is, for example, 0.25.

Although the duty ratio of the pulse supplied to the cam motor M1 is changed depending on whether or not the number of sheets of paper configuring the paper bundle B is equal to or smaller than the number of sheets for load decrease in the example described above, the present invention is not limited to thereto.

For example, the paper processing control section 23 may supply a pulse to the cam motor M1 for a certain time in a case where the number of sheets of paper is larger than the number of sheets for load decrease, and may supply a direct current to the cam motor M1 for a certain time in a case where the number of sheets of paper is equal to or smaller than the number of sheets for load decrease. In addition, in a case where the number of sheets of paper configuring the paper bundle B is equal to or smaller than the number of sheets for load decrease, the paper processing control section 23 may shorten a time for which a current is supplied to the cam motor M1 compared to a case where the number is larger than the number of sheets for load decrease. That is, in a case where the number of sheets of paper configuring the paper bundle B is equal to or smaller than the number of sheets for load decrease, control may be performed such that a load applied to the upper pressing member 51 and the lower pressing member 52 decreases compared to a case where the number is larger than the number of sheets for load decrease.

As described above, in Modification Example, in a case where the number of sheets of paper of the paper bundle B is smaller than the number of sheets for load decrease, the paper processing control section 23 decreases the load on the upper pressing member 51 and the lower pressing member 52 after the decrease in the load on the upper pressing member 51 and the lower pressing member 52 compared to a case where the number is larger.

Modification Example 2

Next, another modification example (Modification Example 2) of the binding control processing will be described.

Figures 9A, 9B:
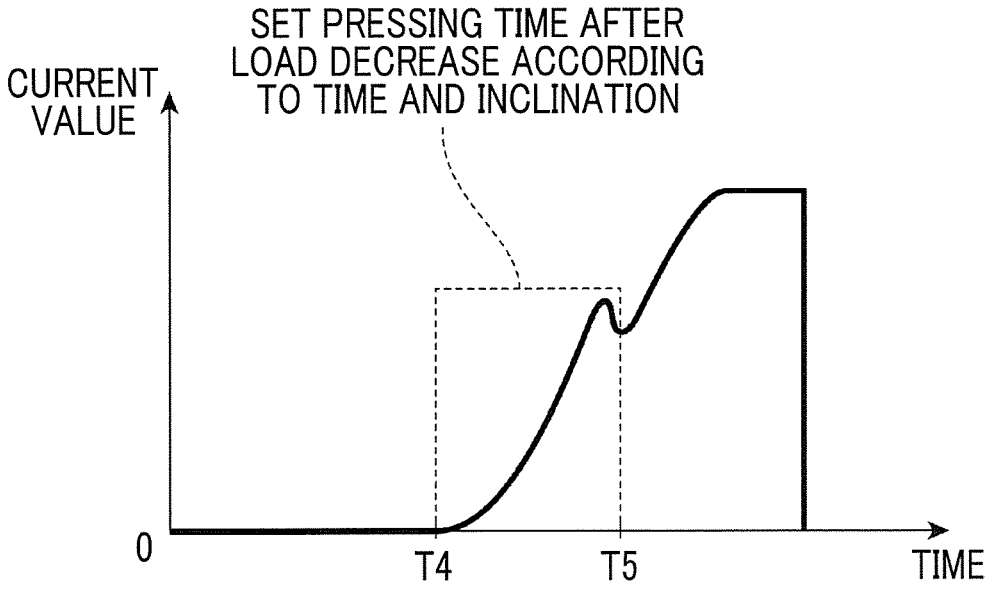
FIG. 9A is a graph showing a relationship between a time elapsed after start of binding processing by a stapleless binding unit and a value of a current supplied to a cam motor.
FIG. 9B is a table showing a correspondence between a length of a time for which the current is supplied until a load applied to an upper pressing member and a lower pressing member decreases and a pressing time after a decrease in the load.

FIG. 9A is a graph showing a relationship between a time elapsed after the stapleless binding unit 50 has started binding processing and a value of a current supplied to the cam motor M1. In addition, FIG. 9B is a table showing a correspondence between the length of a time for which the current is supplied until a load applied to the upper pressing member 51 and the lower pressing member 52 decreases and a pressing time after the decrease in the load.

As described above, in the exemplary embodiment, the pressing is released even after a timing when the load on the upper pressing member 51 and the lower pressing member 52 decreases. Herein, as a pressing time after the load applied to the upper pressing member 51 and the lower pressing member decreases, a time necessary for securing a binding performance varies in some cases according to the number of sheets of paper configuring the paper bundle B to be subjected to binding processing. For example, in a case where the number of sheets of paper configuring the paper bundle B is small, or in a case where the paper bundle B is likely to deform due to a small paper thickness or a large gap, the paper bundle B is likely to follow uneven teeth and also a change in the paper bundle B necessary for binding is likely to occur. On the other hand, in a case where the number of sheets of paper configuring the paper bundle B is large, or in a case where the paper bundle B is unlikely to deform due to a large paper thickness or a small gap, the paper bundle B is unlikely to follow the uneven teeth and also a change in the paper bundle B necessary for binding is unlikely to occur. Therefore, there is a relative relationship between a time for which the paper bundle B follows the uneven teeth, that is, a time taken for a load applied to the upper pressing member 51 and the lower pressing member 52 decreases, and the amount of the load that is necessary thereafter.

Thus, in Modification Example 2, a pressing time after the load applied to the upper pressing member 51 and the lower pressing member 52 decreases is controlled to become a time corresponding to the paper bundle B. More specifically, a pressing time is set according to a time from the start of the supply of the current to the cam motor M1 to a decrease in the load applied to the upper pressing member 51 and the lower pressing member 52. In addition, as for a time immediately before the decrease in the load applied to the upper pressing member 51 and the lower pressing member 52 from the start of the supply of the current to the cam motor M1, a pressing time is set according to an inclination of the value of the current supplied to the cam motor M1 with respect to a time.

A timing when the supply of the current to the cam motor M1 is started after the start of the binding processing is set as a time T4 (refer to FIG. 9A), and a timing when the value of the current supplied to the cam motor M1 decreases is set as a time T5.

In a case where the number of sheets of paper configuring the paper bundle B is large, a time from the time T4 to the time T5 is long in some cases. In this case, also a pressing time necessary to complete binding for the paper bundle B from the time T5 is long. In addition, in a case where the number of sheets of paper configuring the paper bundle B is small, a time from the time T4 to the time T5 is short in some cases. In this case, also a pressing time necessary to complete binding for the paper bundle B from the time T5 is short. In the exemplary embodiment, in a case where the time from the time T4 to the time T5 is long, control is performed such that a pressing time after the load applied to the upper pressing member 51 and the lower pressing member 52 decreases is long. In addition, in a case where the time from the time T4 to the time T5 is short, control is performed such that a pressing time after the load applied to the upper pressing member 51 and the lower pressing member 52 decreases is short. A pressing time after the load applied to the upper pressing member 51 and the lower pressing member 52 decreases will be referred to as a post-decrease pressing time.

In addition, in a case where the number of sheets of paper configuring the paper bundle B is large an inclination of the current value with respect to a time increases in some cases when the value of the current supplied to the cam motor M1 increases. That is, as the paper bundle B has a larger number of sheets of paper, a reaction force of the paper bundle B which is generated in a case of being pressed increases. However, a current value necessary for bringing the upper pressing member 51 and the lower pressing member 52 closer to each other increases by the amount that the reaction force has increased, and the inclination of the current value with respect to a time increases. In addition, in a case where the number of sheets of paper configuring the paper bundle B is small, an inclination of the current value with respect to a time decreases in some cases when the value of the current supplied to the cam motor M1 increases. In the exemplary embodiment, in a case where the inclination of the current value is large, control is performed such that the post-decrease pressing time is long. In addition, in a case where the inclination of the current value is small, control is performed such that the post-decrease pressing time is short.

The monitor S transmits information indicating the value of the current supplied to the cam motor M1 to the paper processing control section 23 for each predetermined time. The predetermined time is, for example, 0.1 seconds. From the information acquired from the monitor S, the paper processing control section 23 calculates the length of the time from the time T4 to the time T5. In addition, the inclination of the current value with respect to a time for which the current is supplied to the cam motor M1 before the load applied to the upper pressing member 51 and the lower pressing member 52 decreases is calculated from the information acquired from the monitor S.

"Time" shown in FIG. 9B means the length of the time from the time T4 to the time T5 calculated by the paper processing control section 23. In addition, "inclination" shown in FIG. 9B means the inclination of the current value calculated by the paper processing control section 23.

In a case where the time from the time T4 to the time T5 is "shorter" than a long-term time and the inclination of the current value is "smaller" than a long-term inclination value, the paper processing control section 23 sets the post-decrease pressing time to a first time. Herein, both of the long-term time and the long-term inclination value are threshold values for determining that it is necessary to lengthen the post-decrease pressing time in order to secure a binding performance.

In addition, in a case where the time from the time T4 to the time T5 is "longer" than the long-term time and the inclination of the current value is "smaller" than the long-term inclination value, the paper processing control section 23 sets the post-decrease pressing time to a second time. The second time is a time that is longer than the first time.

In addition, in a case where the time from the time T4 to the time T5 is "shorter" than the long-term time and the inclination of the current value is "larger" than the long-term inclination value, the paper processing control section 23 sets the post-decrease pressing time to the second time.

Further, in a case where the time from the time T4 to the time T5 is "longer" than the long-term time and the inclination of the current value is "larger" than the long-term inclination value, the paper processing control section 23 sets the post-decrease pressing time to a third time. The third time is a time that is longer than the second time.

Figure 10:
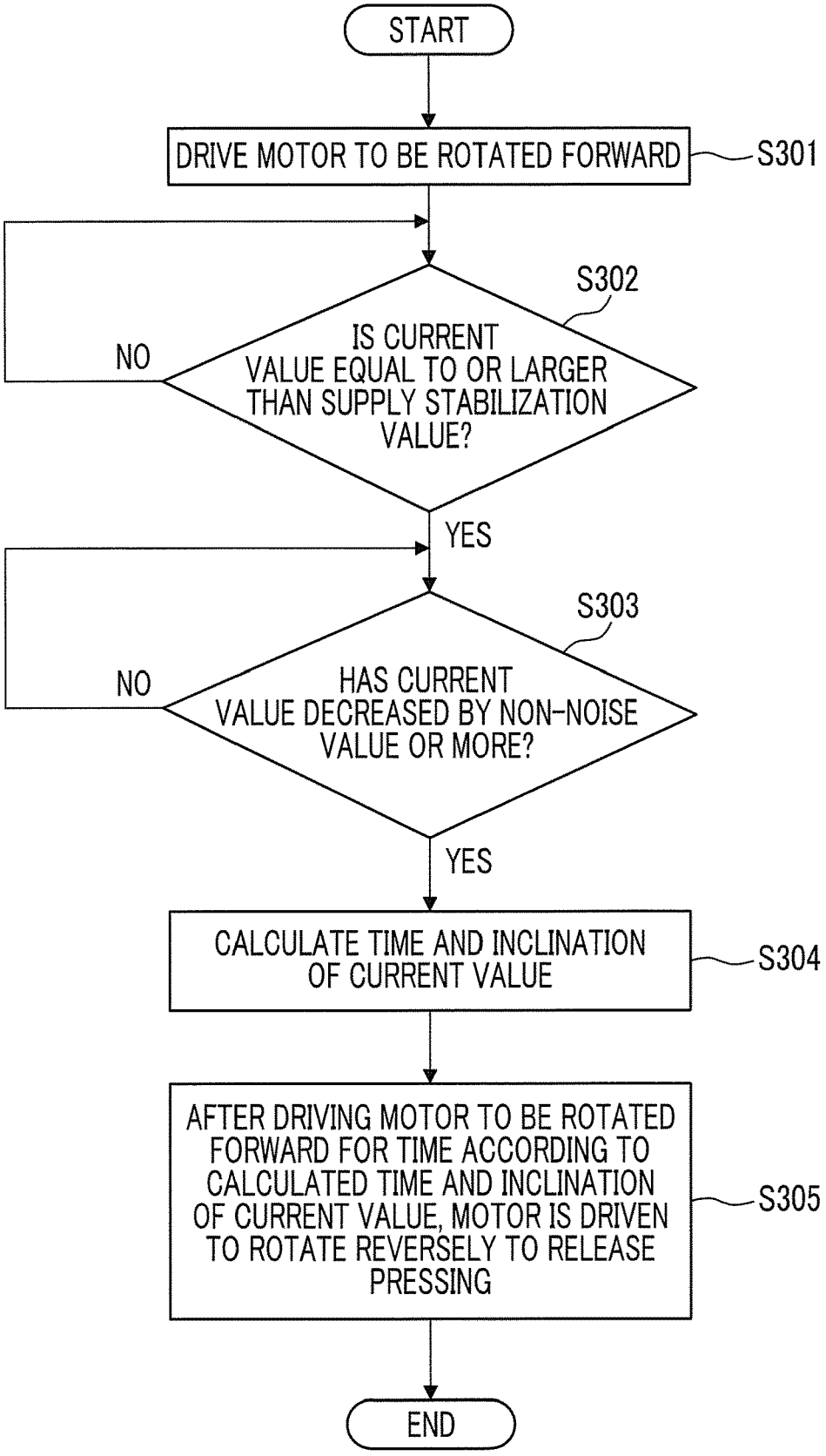
FIG. 10 is a flowchart showing flow of binding control processing of Modification Example 2.

FIG. 10 is a flowchart showing the flow of binding control processing of Modification Example 2.

First, the paper processing control section 23 performs the processing of Steps S301 to S303. Processing of Steps S301 to S303 has content identical to the processing of Steps S102 to S104 of the binding control processing shown in FIG. 7.

In a case where the value of the current supplied to the cam motor M1 decreases by the non-noise value or more (YES in S303), the processing proceeds to the next step.

The paper processing control section 23 calculates a time from the start of the supply of the current to the cam motor M1 to the decrease in the load applied to the upper pressing member 51 and the lower pressing member 52 and an inclination of the value of the current supplied to the cam motor M1 with respect to a time (S304).

The paper processing control section 23 sets the post-decrease pressing time to any one of the first time, the second time, or the third time according to the calculated length of the time and the calculated inclination of the current value. Then, the current is supplied for a set time such that the cam motor M1 is driven to be rotated forward, and the pressing of the paper bundle B by the upper pressing member 51 and the lower pressing member 52 is continued. After then, the paper processing control section 23 drives the cam motor M1 to be rotated reversely to release the pressing of the paper bundle B by the upper pressing member 51 and the lower pressing member 52 (S305).

As described above, in the exemplary embodiment, the paper processing control section 23 controls the pressing time for the upper pressing member 51 and the lower pressing member 52 even after the timing when the load on the upper pressing member 51 and the lower pressing member 52 decreases. More specifically, in the exemplary embodiment, the paper processing control section 23 sets a pressing time based on a time from the start of pressing of the paper bundle B by the upper pressing member 51 and the lower pressing member 52 to the decrease in the load on the upper pressing member 51 and the lower pressing member 52.

Although the exemplary embodiment of the present invention has been described hereinbefore, the technical scope of the present invention is not limited to the scope described in the exemplary embodiment. It is clear from the description of the claims that various modifications or improvements to the exemplary embodiment are included in the technical scope of the present invention.

In the exemplary embodiment, in a case where a decrease in a value of a current supplied to the cam motor M1 is detected, the monitor S detects a decrease in a load applied to the upper pressing member 51 and the lower pressing member 52. Herein, a technique of detecting the decrease in the load applied to the upper pressing member 51 and the lower pressing member 52 is not limited to a technique of detecting the current value.

For example, the stapleless binding unit 50 may be provided with an output sensor that detects the output of the cam motor M1. The output of the cam motor M1 is a force from the cam motor M1 to drive the cam 59. In a case where a value of a current supplied to the cam motor M1 decreases, the output of the cam motor M1 reduces. In other words, in a case where a load applied to the upper pressing member 51 and the lower pressing member 52 decreases, the output of the cam motor M1 necessary for bringing the upper pressing member 51 and the lower pressing member 52 closer to each other reduces. Thus, the output sensor may detect a reduction in the driving force of the cam motor M1. More specifically, in a case of detecting the reduction in the output of the cam motor M1, the output sensor may detect the decrease in the load applied to the upper pressing member 51 and the lower pressing member 52. Then, in a case where the output sensor notifies that the load applied to the upper pressing member 51 and the lower pressing member 52 has decreased, the paper processing control section 23 may control the subsequent pressing time. In this case, the output sensor is regarded as a detecting unit that detects the reduction in the load on the upper pressing member 51 and the lower pressing member 52.

In addition, the stapleless binding unit 50 may be provided with a distance sensor that detects a distance between the upper uneven part 54 of the upper pressing member 51 (refer to FIG. 6B) and the lower uneven part 58 of the lower pressing member 52. When a load applied to the upper pressing member 51 and the lower pressing member 52 decreases, a degree to which the upper uneven part 54 and the lower uneven part 58 come closer to each other per unit time increases as the paper bundle B enters the gap G1 and the gap G2 which are illustrated in FIG. 6B. Thus, the distance sensor may detect the decrease in the load applied to the upper pressing member 51 and the lower pressing member 52 in a case where it is detected that a change amount of a distance between the upper protruding portion 54*a* and the lower recessed portion 58*b* facing the upper protruding portion 54*a* per unit time is larger than a predetermined change amount. The predetermined change amount is a threshold value for determining that the load applied to the upper pressing member 51 and the lower pressing member 52 has decreased. Then, in a case where the distance sensor notifies that the load applied to the upper pressing member 51 and the lower pressing member 52 has decreased, the paper processing control section 23 may control the subsequent pressing time. In this case, the distance sensor is regarded as a detecting unit that detects a reduction in the load on the upper pressing member 51 and the lower pressing member 52.

In addition, the stapleless binding unit 50 may be provided with a pressure sensor that detects a pressure applied to the paper bundle B by the upper pressing member 51 and the lower pressing member 52. When a load applied to the upper pressing member 51 and the lower pressing member 52 decreases, the pressure applied to the paper bundle B by the upper pressing member 51 and the lower pressing member 52 decreases. Thus, in a case where the decrease in the pressure applied to the paper bundle B is detected, the pressure sensor may detect the decrease in the load applied to the upper pressing member 51 and the lower pressing member 52. Then, in a case where the pressure sensor notifies that the load applied to the upper pressing member 51 and the lower pressing member 52 has decreased, the paper processing control section 23 may control the subsequent pressing time. In this case, the pressure sensor is regarded as a detecting unit that detects a reduction in the load on the upper pressing member 51 and the lower pressing member 52.

In addition, although a case where the paper processing control section 23 controls a pressing time is described in the exemplary embodiment, the present invention is not limited thereto.

For example, the paper processing control section 23 may control a pressure applied to the paper bundle B by the upper pressing member 51 and the lower pressing member 52 according to a timing when a load applied to the upper pressing member 51 and the lower pressing member 52 decreases. For example, instead of lengthening a time for which the paper bundle 3 is pressed, the paper processing control section 23 may increase a value of a current supplied to the cam motor M1 and increase a pressing force applied to the paper bundle B by the upper pressing member 51 and the lower pressing member 52. In addition, instead of shortening a time for which the paper bundle B is pressed, the paper processing control section 23 may decrease a value of a current supplied to the cam motor M1 and decrease a pressing force applied to the paper bundle B by the upper pressing member 51 and the lower pressing member 52.

In addition, the stapleless binding unit 50 may be provided with a rotation number sensor that detects a rotation number of the cam motor M1. Then, the paper processing control section 23 may acquire information of the rotation number of the cam motor M1 from the rotation number sensor and control the rotation number of the cam motor M1 based on the acquired information. For example, after a decrease in a load on the upper pressing member 51 and the lower pressing member 52, the paper processing control section 23 may perform control such that pressing by the upper pressing member 51 and the lower pressing member 52 is released by rotating the cam motor M1 forward at a predetermined number of times and rotating the cam motor M1 reversely. The predetermined number of times is the rotation number of the cam motor M1 necessary for performing the binding of the paper bundle B after the decrease in the load on the upper pressing member 51 and the lower pressing member 52. In addition, for example, instead of lengthening a time for which the paper bundle B is pressed, the paper processing control section 23 may increase the rotation number of the cam motor M1 until binding ends. In addition, instead of shortening the time for which the paper bundle B is pressed, the paper processing control section 23 may decrease the rotation number of the cam motor M1 until binding ends.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding device comprising:

a pressing member that has a first tooth, which forms unevenness in a recording material bundle, and a second tooth, which is paired with the first tooth and forms unevenness in the recording material bundle, and presses the recording material bundle with the recording material bundle sandwiched between the first tooth and the second tooth; and a control unit that performs control such that pressing is released after a timing when a load on the pressing member decreases from start of pressing of the recording material bundle by the pressing member.

2. The binding device according to claim 1, further comprising:

a detecting unit that detects a decrease in the load on the pressing member after the start of the pressing of the recording material bundle by the pressing member, wherein the control unit performs control such that the pressing is released after a timing when the decrease in the load is detected by the detecting unit.

3. The binding device according to claim 2, further comprising:

a driving unit that drives the pressing member by a driving force, wherein the detecting unit detects a reduction in the driving force of the driving unit.

4. The binding device according to claim 2, further comprising:

a driving unit that drives the pressing member by a supplied current, wherein the detecting unit detects a decrease in a value of the current.

5. The binding device according to claim 4, wherein the detecting unit detects the decrease in the load on the pressing member in a case where the value of the current has decreased by 0.5 A or more.

6. The binding device according to claim 1, wherein the control unit controls a pressing time of the pressing member after the timing of the pressing member.

7. The binding device according to claim 6, wherein the control unit sets the pressing time based on a time from the start of the pressing of the recording material bundle by the pressing member to a decrease in the load on the pressing member.

8. The binding device according to claim 1, wherein the control unit performs the control in a case where the number of sheets of the recording materials of the recording material bundle is larger than a predetermined first number of sheets.

9. The binding device according to claim 1, wherein in a case where the number of sheets of the recording materials of the recording material bundle is smaller than a predetermined second number of sheets, the control unit decreases the load on the pressing member after a decrease in the load on the pressing member than a case where the number of sheets of the recording materials of the recording material bundle is larger than the predetermined second number of sheets.

10. A binding device comprising:

a pressing member that has a first tooth which has a first recessed portion and a first protruding portion, which form unevenness in a recording material bundle, and a second tooth which has a second recessed portion and a second protruding portion, which form unevenness in the recording material bundle, and is paired with the first tooth, and presses the recording material bundle with the recording material bundle sandwiched between the first tooth and the second tooth; and a control unit that performs control such that pressing is released after a timing when a load on the pressing member decreases from start of pressing of the recording material bundle by the pressing member.

11. An image forming system comprising:

an image forming apparatus that performs image forming on a recording material; and a binding device that executes binding on a recording material bundle, which is a bundle of the recording materials on which an image is formed by the image forming apparatus, wherein the binding device is the binding device according to claim 1.

12. A binding device comprising:

a pressing member that has a first tooth, which forms unevenness in a recording material bundle, and a second tooth, which is paired with the first tooth and forms unevenness in the recording material bundle, and presses the recording material bundle with the recording material bundle sandwiched between the first tooth and the second tooth; and control means for performing control such that pressing is released after a timing when a load on the pressing member decreases from start of pressing of the recording material bundle by the pressing member.

* * * * *